US005215016A

United States Patent [19]

Futami

[11] Patent Number: 5,215,016

[45] Date of Patent: Jun. 1, 1993

[54] RAIL TYPE UNDERWATER TRAVEL VEHICLE

[75] Inventor: Hiroshi Futami, Yamaguchi, Japan

[73] Assignee: Koyo Engineering Co., Ltd., Shimonoseki, Japan

[21] Appl. No.: 841,919

[22] Filed: Feb. 25, 1992

[51] Int. Cl.[5] ..... A63G 3/06

[52] U.S. Cl. ..... 104/71; 104/247

[58] Field of Search ..... 104/71, 59, 69, 73, 104/139, 245, 247, 295, 296, 94, 106, 287, 288, 95, 138.1, 23.2

[56] References Cited

U.S. PATENT DOCUMENTS 728,062 5/1903 Wilson ..... 104/71
743,816 11/1903 Brady ..... 104/71
965,768 7/1910 Van Sant ..... 104/139
1,849,226 3/1932 Erban ..... 104/71
3,114,333 12/1963 Fowler et al. ..... 104/71
3,626,857 12/1971 Omar ..... 104/247

FOREIGN PATENT DOCUMENTS 6011 of 1910 United Kingdom ..... 104/71

*Primary Examiner*—Robert J. Oberleitner
*Assistant Examiner*—Kevin D. Rutherford
*Attorney, Agent, or Firm*—Jordan and Hamburg

[57] ABSTRACT

A rail type underwater travel vehicle includes a passenger observation room, an engine room housing drive apparatus and a flotation adjustment tank chamber. The vehicle can travel freely from land into water by means of drive tires that are rotated by the drive apparatus, the drive tires riding on a pair of travel guides extending from the land into the water.

6 Claims, 4 Drawing Sheets

RAIL TYPE UNDERWATER TRAVEL VEHICLE

BACKGROUND OF THE INVENTION

This invention relates to a rail type underwater travel vehicle that enables safe sightseeing underwater travel, even in rough weather.

Glass bottom boats or sightseeing underwater vessels have been used for underwater observations in the ocean or in lakes. It is impossible with such boats or underwater vessels, however, to travel in rough weather and therefore the sightseeing passengers are not sufficiently satisfied by travel therein.

SUMMARY OF THE INVENTION

The object of the present invention is to provide an underwater travel vehicle that enables safe underwater observation even in rough weather, in order to overcome the above problems.

The underwater travel vehicle of the present invention is a rail type underwater travel vehicle that supports an underwater travel vehicle including a sightseeing passenger room, an engine room housing drive apparatus and a vehicle body flotation adjustment tank chamber for use in flotation adjustment between a pair of travel guides mounted to extend from land into a body of water. Drive tires are rotated by the drive apparatus and are located on axially opposite sides of the engine room. The guide tires are inset inside travel channel portions formed on the inner surfaces of the travel guides. Travel on land is effected by the rolling of the drive tires on lower end surfaces of the drive channel portions, due to the weight of the underwater travel vehicle. Travel under water is effected by the rolling of the drive tires on upper end surfaces of the travel channel portions due to a difference in the flotation of the vehicle adjusted by the vehicle body flotation adjustment tank chamber.

BRIEF DESCRIPTION OF THE DRAWINGS

In order that the invention may be more clearly understood, it will now be disclosed in greater detail with reference to the accompanying drawings, wherein.

DESCRIPTION OF THE PREFERRED EMBODIMENTS

Figure 1:
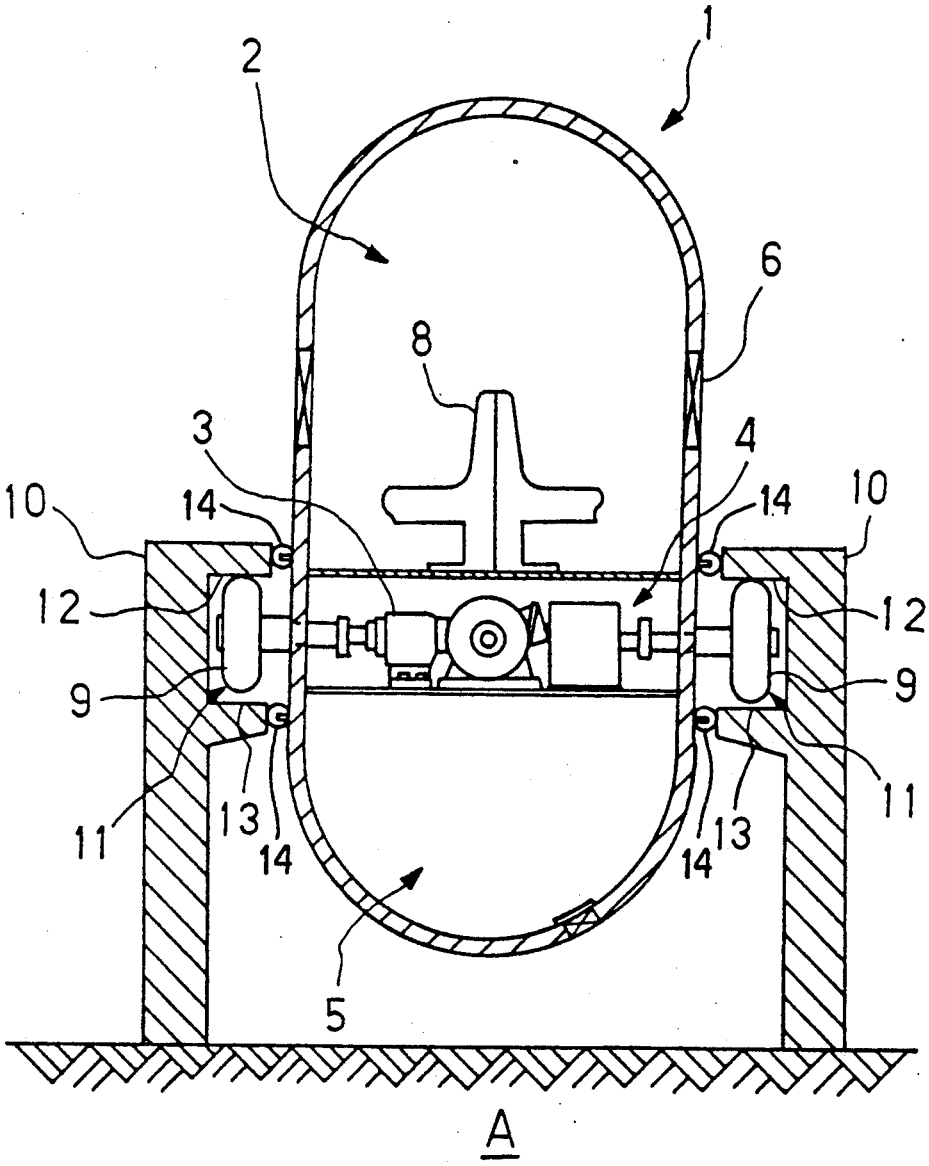
FIG. 1 is a sectional explanatory diagram that shows the interior mechanism of the underwater travel vehicle of the present invention.

The construction and operation of an example of the present invention will be explained with reference to the drawings. FIG. 1 shows the interior mechanism of the underwater travel vehicle, wherein underwater travel vehicle main element 1 is comprised of: (a) sealed observation room 2, (b) engine room 4 that houses drive apparatus 3 such as an electric motor and the drive power source, and (c) vehicle body weight adjustment tank 5.

In the observation room 2 are observation window portions 6, and observation seats 8 mounted on the center of a bottom portion. Drive tires 9,9 are mounted axially on opposite sides of the engine room 4, in a mechanism such that they are rotated by drive apparatus 3 inside of the engine room 4 via drive shafts 15. The drive tires 9,9 are arranged symmetrically to the right and left on opposite sides of the underwater travel vehicle 1, and are further inset into travel channel portions 11, 11 that project inward on the upper potions of travel guides 10,10 standing on foundation A. The inside upper end surfaces of these travel channels 11, 11 comprise underwater travel surfaces 12,12 and the inside lower end surfaces of travel channels 11,11 comprise ground travel surfaces 13,13. In the drawings, 14,14 are anti-rocking rollers.

Figure 2:
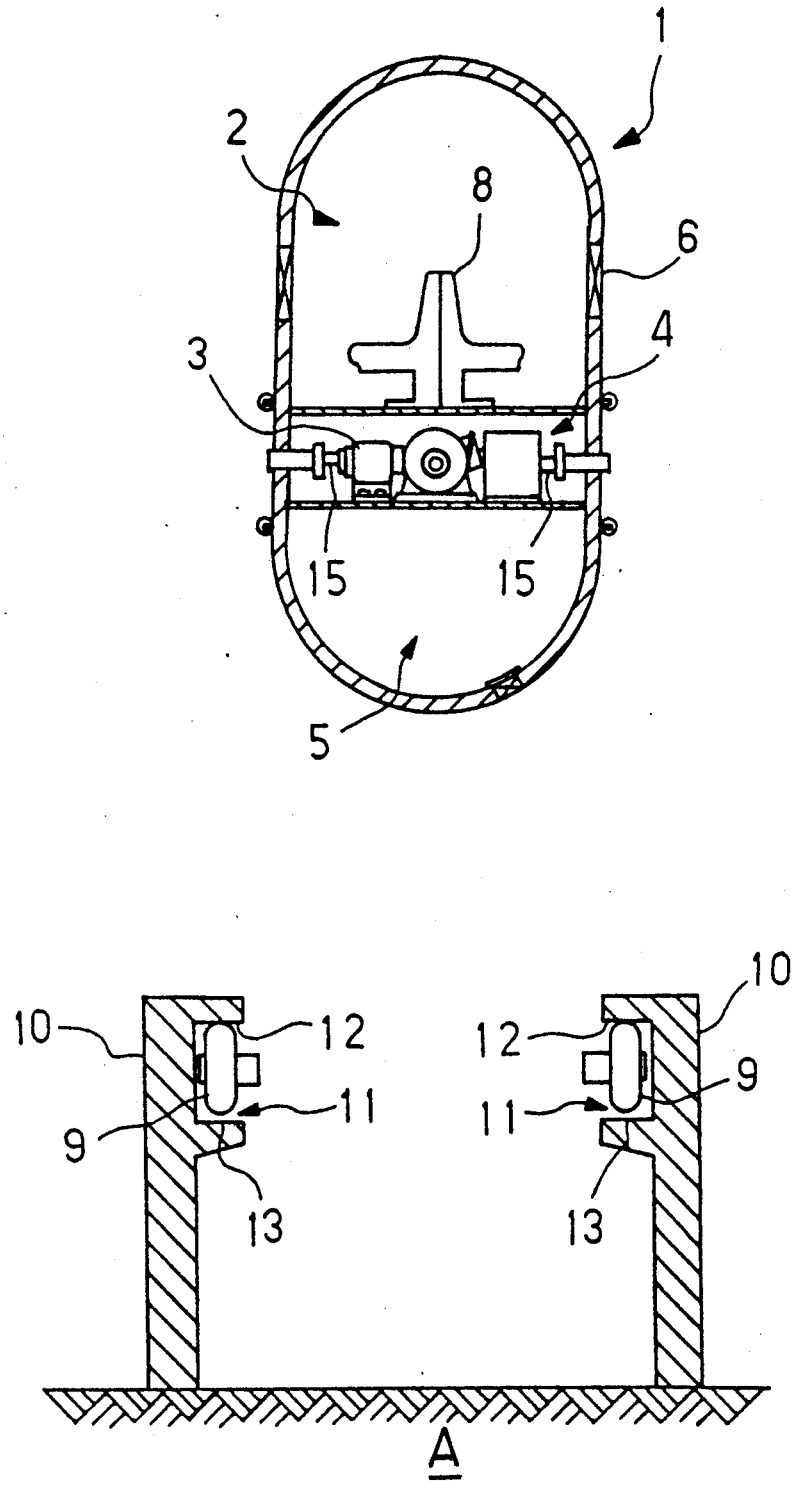
FIG. 2 is an explanatory diagram that shows the flotation mechanism of the underwater travel vehicle at time of an emergency.

FIG. 2 shows the flotation state of the underwater travel vehicle in an emergency. During the emergency, drive tires 9,9 are released from portions of the drive shafts 15 and the vehicle floats up to the surface where it can be tugged or the passengers can be taken off by a rescue boat. The vehicle body weight adjustment tank 5 includes a mechanism that internally stores water by means of automatic injection and discharge in order to accomplish flotation adjustment of the underwater travel vehicle under water, and discharges water for travel on land.

Figure 3:
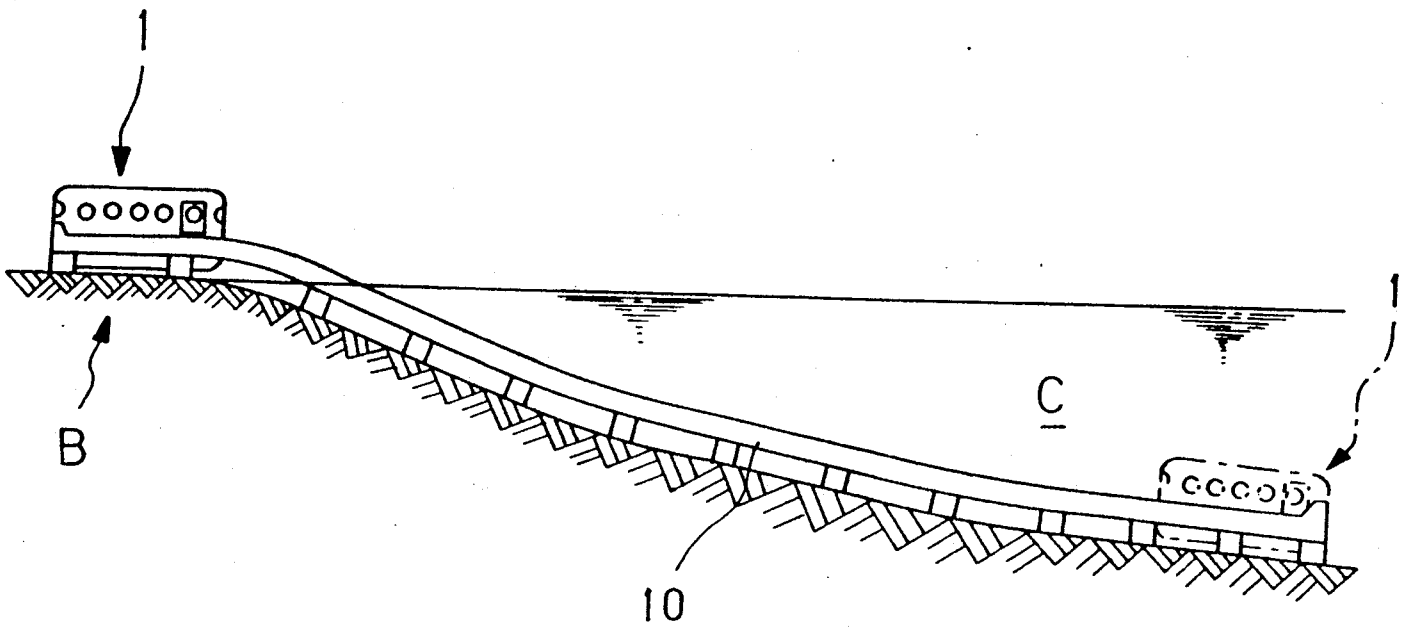
FIG. 3 is an explanatory diagram that shows an overall view of the present invention.

FIG. 3 shows an overview of the present invention, wherein travel guides 10,10 extend from wharf B into the water of the ocean or a like, and the underwater travel vehicle main element 1 is supported between the guides 10,10 and travels from the land into the water.

Figure 4:
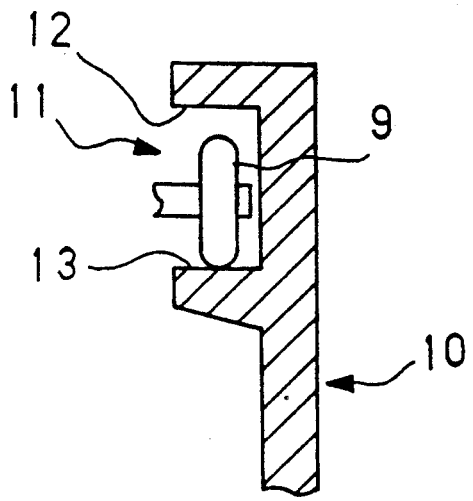
FIG. 4 is an explanatory view that shows the condition when the drive tire is travelling on land.

FIG. 4 shows the travel condition on land when drive tires 9 rotate while in contact with land travel surfaces 13 inside travel channel portions 11 due to the inherent weight of underwater travel vehicle main element 1 as it travels into the water.

Figure 5:
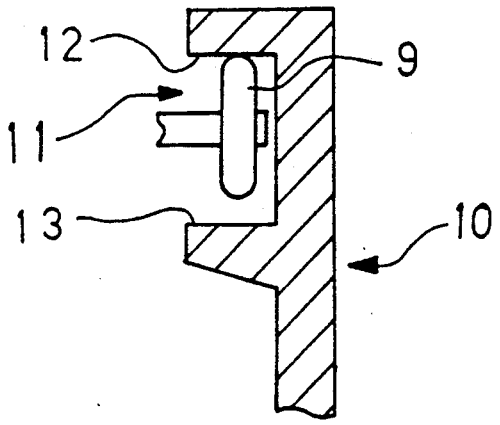
FIG. 5 is an explanatory view that shows the condition when the drive tire is travelling underwater.

FIG. 5 shows the travel condition in the water when water is automatically injected into the vehicle flotation adjustment tank chamber 5 simultaneously with submersion to carry out flotation adjustment, while at the same time drive tires 9 rotate because of the rolling contact with underwater travel surfaces 12 while underwater travel is effected along travel guides 10,10.

The travel guides 10 may be arranged in a round trip mode or a loop mode. Although the described example shows a large model underwater travel vehicle capable of carrying a plurality of persons, underwater travel vehicles that carry one or two persons may alternatively be considered.

The present invention, as described above, makes sightseeing operations possible even in rough weather, and does not produce rocking from wave action, as is produced when using a boat, so that safe and secure travel is possible. Further, getting into and out of the vehicle is very convenient because the vehicle travels from the land into the water. The invention enables far better sightseeing than was heretofore possible, for example, when incorporated into resort facilities such as hotels.

Although the present invention has been fully described by way of example with reference to the accompanying drawings, it is to be understood that various changes and modifications will be apparent to those skilled in the art. Therefore, unless such changes and modifications depart from the scope of the invention, they should be construed as being included therein.

What is claimed is:

1. A rail type underwater travel vehicle for use with a pair of opposite travel guides on opposite sides of said vehicle and extending from land into a body of water, each travel guide having an upper track and a substantially parallel lower track in spaced relation thereto, said vehicle comprising:

a sightseeing passenger room, an engine room, drive tires mounted axially on opposite sides of said engine room of said vehicle, said drive tires being inset into said travel guides for riding along said tracks, said drive tires having a diameter less than the distance between said upper and lower tracks, drive means in said engine room for directly rotatably driving said drive tires along said tracks so as to propel said vehicle along said travel guides, and vehicle body flotation adjustment tank chamber means for adjusting flotation of said vehicle by receiving and discharging water therein, such that travel on land is effected by rotatably driving said drive tires only on said lower tracks and out of contact with said upper tracks due to the weight of said underwater travel vehicle and such that travel under water is effected by rotatably driving said drive tires only on said upper tracks and out of contact with said lower tracks due to flotation of the vehicle.

2. An underwater travel vehicle comprising a vehicle body having:

a sightseeing passenger room, an engine housing, a vehicle body flotation adjustment chamber including means for adjusting flotation of said vehicle body, drive tires mounted externally of said body on opposite sides thereof, drive means in said engine housing for directly rotatably driving said tires, and means for releasing said drive tires from said drive means when said vehicle is in a body of water so as to permit said vehicle to float to the surface of said body of water.

3. An underwater travel system, comprising:

a) a pair of opposite, spaced apart travel guides extending from land into a body of water, each travel guide having an upper track and a substantially parallel lower track in spaced relation thereto, and b) an underwater travel vehicle including:

i) a sightseeing passenger room, ii) an engine room, iii) drive tires mounted axially on opposite sides of said engine room of said vehicle, said drive tires being inset into said travel guides for riding along said tracks, said drive tires having a diameter less than the distance between said upper and lower tracks, iv) drive means in said engine room for directly rotatably driving said drive tires along said tracks so as to propel said vehicle along said travel guides, and v) vehicle body flotation adjustment tank chamber means for adjusting flotation of said vehicle by receiving and discharging water therein, such that travel on land is effected by rotatably driving said drive tires only on said lower tracks and out of contact with said upper tracks due to the weight of said underwater travel vehicle and such that travel under water is effected by rotatably driving said drive tires only on said upper tracks and out of contact with said lower tracks due to flotation of the vehicle.

4. The underwater travel system of claim 3, further comprising means for releasing said drive tires from said drive means.

5. The underwater travel system of claim 3, wherein said upper and lower tracks have end faces directed toward said vehicle, and further comprising antirocking rollers mounted on said vehicle and positioned to engage said end faces of said upper and lower tracks to prevent rocking of said vehicle when said vehicle is riding on said upper and lower tracks.

6. The underwater travel system of claim 3, further comprising means for fixedly mounting said travel guides to extend from land into a body of water.

* * * * *